US009841252B2

(12) United States Patent
Santos Reis

(10) Patent No.: US 9,841,252 B2
(45) Date of Patent: Dec. 12, 2017

(54) SYSTEM AND METHOD FOR AIDING REPEATED FIRING OF SEMI-AUTOMATIC WEAPON

(71) Applicant: Luiz Fernando Santos Reis, Miami Beach, FL (US)

(72) Inventor: Luiz Fernando Santos Reis, Miami Beach, FL (US)

( * ) Notice: Subject to any disclaimer, the term of this patent is extended or adjusted under 35 U.S.C. 154(b) by 0 days.

(21) Appl. No.: 15/166,937

(22) Filed: May 27, 2016

(65) Prior Publication Data

US 2016/0377364 A1 Dec. 29, 2016

Related U.S. Application Data

(63) Continuation-in-part of application No. 15/005,760, filed on Jan. 25, 2016, now abandoned.

(60) Provisional application No. 62/107,151, filed on Jan. 23, 2015.

(51) Int. Cl.
*F41A 19/69* (2006.01)
*F41A 19/46* (2006.01)
*F41A 19/58* (2006.01)

(52) U.S. Cl.
CPC ..... *F41A 19/69* (2013.01); *F41A 19/46* (2013.01); *F41A 19/58* (2013.01)

(58) Field of Classification Search
CPC ..... F41A 19/46; F41A 19/58; F41A 19/64; F41A 19/65; F41A 19/67; F41A 19/69
See application file for complete search history.

(56) References Cited

U.S. PATENT DOCUMENTS 5,083,392 A * 1/1992 Bookstaber ..... F41A 17/06 42/84
5,485,776 A * 1/1996 Ealovega ..... F41A 19/33 89/130
5,713,150 A * 2/1998 Ealovega ..... F41A 19/59 42/84
5,890,479 A * 4/1999 Morin ..... F41B 11/00 124/31
6,802,305 B1 * 10/2004 Hatcher ..... F41A 19/10 124/31
6,976,416 B2 * 12/2005 Ealovega ..... F41A 19/46 89/129.01
7,073,284 B2 * 7/2006 Monks ..... F41A 19/10 124/31
7,487,768 B2 * 2/2009 Hatcher ..... F41A 11/02 124/31
8,336,438 B2 * 12/2012 Compton ..... F41A 19/59 89/132

(Continued)

*Primary Examiner* — Stephen Johnson
*Assistant Examiner* — Joshua T Semick
(74) *Attorney, Agent, or Firm* — Mark Terry

(57) ABSTRACT

A method for aiding repeated firing of a semiautomatic firearm having a trigger and a bolt includes means for detecting that the bolt has translated rearwardly at least a first predetermined distance due to firing the firearm, means for calculating a particular time when the bolt will be in a chambered position, responsive to detecting that the bolt has translated rearwardly at least the first predetermined distance and, means for applying a forward biasing force to translate the trigger from a fired to an un-fired position, at the particular time the bolt is in the chambered position, and subsequently removing said forward biasing force.

6 Claims, 23 Drawing Sheets

(56) References Cited

U.S. PATENT DOCUMENTS

| | | | | |
|---|---|---|---|---|
| 8,360,042 | B2 * | 1/2013 | Skilling | F41A 1/06 124/71 |
| 8,807,007 | B2 * | 8/2014 | Alicea | F41A 17/06 89/28.1 |
| 9,146,064 | B2 * | 9/2015 | Whittington | F41A 19/09 |
| 9,551,546 | B2 * | 1/2017 | Alicea, Jr. | F41A 17/20 |

* cited by examiner

SYSTEM AND METHOD FOR AIDING REPEATED FIRING OF SEMI-AUTOMATIC WEAPON

CROSS-REFERENCE TO RELATED APPLICATIONS

This patent application is a continuation in part of application Ser. No. 15/005,760 filed Jan. 25, 2016 and entitled SYSTEM AND METHOD FOR AIDING REPEATED FIRING OF SEMI-AUTOMATIC WEAPON, which claims priority to provisional application No. 62/107,151 filed Jan. 23, 2015 and entitled ELECTRICALLY RESET TRIGGER FOR SEMI-AUTOMATIC WEAPON. The subject matter of application Ser. Nos. 15/005,760 and 62/107,151 are hereby incorporated by reference in their entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The disclosed embodiments relate to the field of firearms and more specifically to accessories for firearms.

BACKGROUND

Firearms enthusiasts often enjoy repeatedly firing their weapons in a rapid manner. A semi-automatic firearm fires one round with each individual trigger-pull. However, it takes substantial practice in order to achieve a high rate of fire in a typical semi-automatic weapon. Additionally, factors such as muscle fatigue, cramping, carpal tunnel and arthritis can make it impossible for some to ever achieve this. This has led to popular public interest in bump fire stocks.

A bump fire stock is a firearm stock that is attached to a semi-automatic weapon in order to allow a process called bump firing. Bump firing is the act of using the recoil of a semi-automatic firearm to fire multiple shots in rapid succession. This process involves holding the fore-grip of the firearm with the non-trigger hand (usually the left hand), releasing the grip on the firing hand (leaving the trigger finger in its normal position in front of the trigger), pushing the rifle forward in order to apply pressure on the trigger finger from the trigger, and keeping the trigger finger stationary. During a shot, the firearm will recoil considerably ("bump" back) and the trigger will be allowed to reset. Subsequently, the non-trigger hand would naturally force the firearm back to the original position, pressing the trigger against a stationary finger again, thereby firing successive shots.

While potentially being fun, bump firing a weapon has little practical application. Due to the large reciprocating mass of the weapon on the stock, it is nearly impossible to take accurate subsequent shots. Additionally, the different simultaneous isometric forces required of the user by this method make it un-reliable and counter-intuitive, as this combination of bodily moves is not one that most shooters are accustomed to performing Thus, in addition to there being a learning curve associated with using said bump fire stocks in a proficient way, they cannot be used for practical applications such as competition and defense.

As a result, there exists a need for improvements over the prior art and more particularly for a more effective device for aiding the rapid sequential firing of semi-automatic weapons.

SUMMARY

A method for aiding repeated firing of a semiautomatic firearm having a trigger and a bolt is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the method for aiding repeated firing of a semiautomatic firearm having a trigger and a bolt includes means for detecting that the bolt has translated rearwardly at least a first predetermined distance due to firing the firearm, means for calculating a particular time when the bolt will be in a chambered position, responsive to detecting that the bolt has translated rearwardly at least the first predetermined distance and, means for applying a forward biasing force to translate the trigger from a fired to an un-fired position, at the particular time the bolt is in the chambered position, and subsequently removing said forward biasing force.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the claimed subject matter and together with the description, serve to explain the principles of the disclosed embodiments. The embodiments illustrated herein are presently preferred, it being understood, however, that the claimed subject matter is not limited to the precise arrangements and instrumentalities shown, wherein:

DETAILED DESCRIPTION

Figure 1:
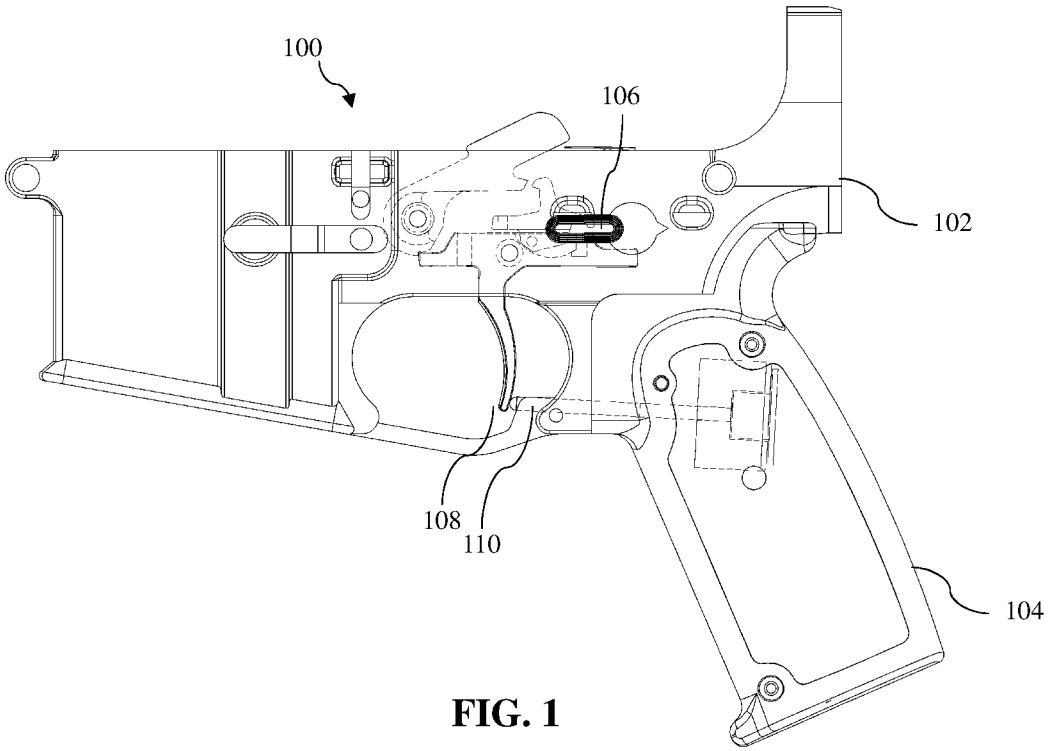
FIG. 1 is an illustration of a side view of a system for aiding the rapid sequential firing of a semi-automatic weapon, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting, reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a more efficient system for aiding the rapid sequential firing of a semi-automatic weapon. The disclosed embodiments improve over the prior art by providing a device that aids the rapid sequential firing of a semi-automatic weapon without requiring that the shooter make any movements or take any actions that are very different from the firing of a conventional semiautomatic weapon. Thus, there is no learning curve associated with using said disclosed embodiments. The disclosed embodiments allow the shooter to take faster and more accurate shots without requiring that he or she perform movements which would be considered awkward and unnatural by most experienced shooters. Additionally, the elimination of the reciprocating motion of the firearm means it moves off-target much less after each shot is fired. Thus, the disclosed embodiments increase accuracy and precision of shots on a target, and increase stability and balance while shooting.

Referring now to the Figures, FIG. 1 is an illustration of a side view of a system 100 for aiding the rapid sequential firing of a semi-automatic weapon, according to an example embodiment. The system shows the receiver 102 for the semiautomatic weapon, which may be any conventional semiautomatic weapon, such as an AR-15. The receiver 100 is the part of a firearm that houses the operating parts. Since the firearm is a conventional semiautomatic weapon, the receiver contains the bolt carrier group, trigger group, and magazine port. The receiver holds the magazine or rotary magazine as well as the trigger mechanism. The receiver is often made of forged, machined or stamped steel, nickel or aluminum. Alternative materials include polymers and sintered metal powders.

FIG. 1 also shows a pistol grip 104 that is held by the hand and orients the hand in a forward, vertical orientation, similar to the position one would take with a conventional pistol. FIG. 1 further shows a trigger 108 mechanism that actuates the firing sequence of the firearm, and a plunger or rod 110 that electrically actuates or moves the trigger into the firing position, as explained more fully below. The plunger is positioned to contact the trigger of the weapon, and the plunger adapted to be movable between a first position and a second position, wherein in the first position the trigger is in an unfired position, and in the second position the trigger is in a fired position.

Also shown in FIG. 1 is the selector switch 106 for placing the system 100 in one of the following modes: 1) a safety mode wherein said trigger 108 cannot move from the first position to the second position, which therefore cannot be moved from the unfired position to the fired position; 2) a non-assisted firing mode wherein said trigger is able to move from the first position to the second position, however, the processor does not signal the solenoid to apply a forward biasing force and assist in resetting the trigger, therefore functioning identically to a conventional semi-automatic firearm; 3) an aided rapid firing mode wherein the weapon is adapted for assisting in the translation of the trigger from the fired position to the un-fired position immediately after each shot by means of a forward biasing force. Here, when a force is continuously applied to the front side of the trigger, the device facilitates the user recursively placing the trigger in a fired position.

Figure 2:
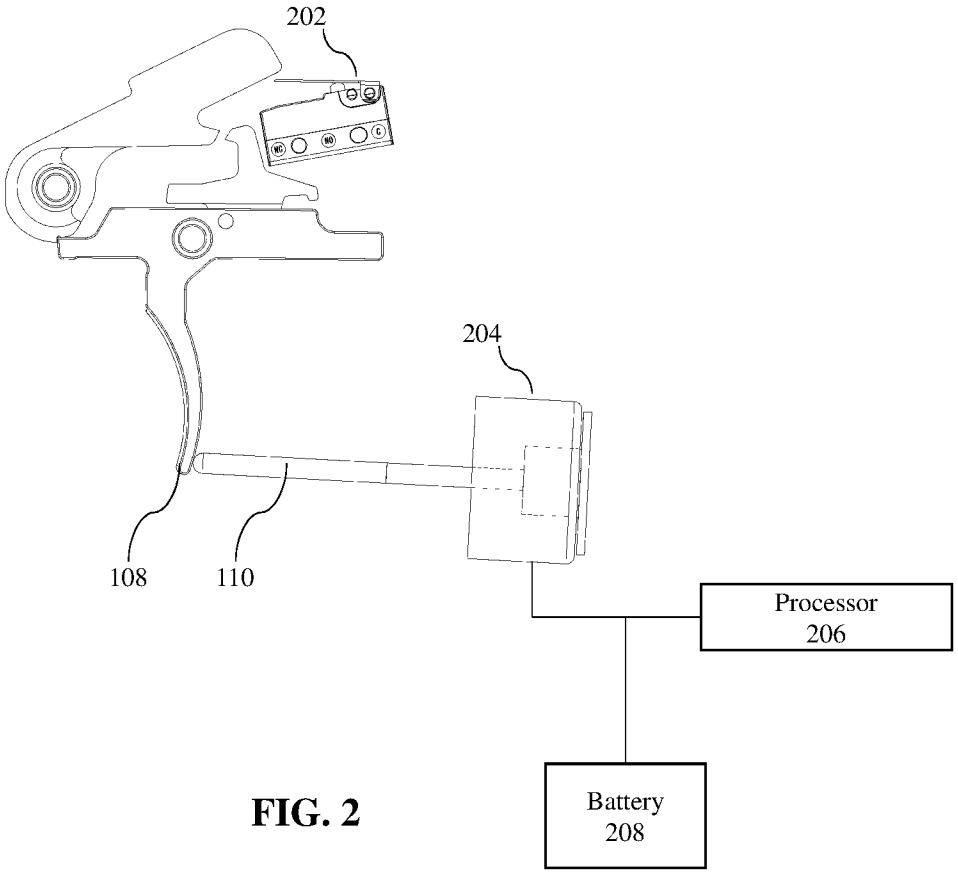
FIG. 2 is an illustration of a side view of the internal components of a system for aiding the rapid sequential firing of a semi-automatic weapon, according to an example embodiment.

FIG. 2 is an illustration of a side view of the internal components of the system 100 for aiding the rapid sequential firing of a semi-automatic weapon, according to an example embodiment. FIG. 2 shows that the system 100 includes a rechargeable battery 208, which can be located in a variety of locations, such as in the pistol grip, buttstock or vertical fore-grip of the weapon. Also shown is a solenoid 204, wherein the solenoid is conductively coupled with the battery, and wherein the solenoid can be located in a variety of locations, such as in the pistol grip of the weapon. FIG. 2 also shows the plunger 110 located in the system 100 and positioned to contact the trigger 108 of the weapon. FIG. 2 further shows the bolt position sensor 202 for placement in the receiver 102 of the semiautomatic weapon, the sensor for sensing when the bolt of the weapon has reached a chambered position, and is therefore ready to fire another round.

Lastly, FIG. 2 shows a processor conductively coupled with the bolt position sensor 202 and with the solenoid 204, the processor configured for: detecting when the bolt has translated rearwardly at least a first predetermined distance due to firing the firearm; detecting when the bolt has translated forwardly a second predetermined distance after the bolt has translated rearwardly; commencing a timer for a predetermined time period corresponding to an amount of time necessary for the bolt to reach a chambered position, responsive to detecting when the bolt has translated forwardly the second predetermined distance; and sending a signal to the solenoid commanding that the solenoid apply a forward biasing force to translate the trigger from a fired to an un-fired position, responsive to the timer reaching an end of the predetermined time period, and subsequently removing said forward biasing force, thereby moving the trigger into the unfired position.

Note that although FIG. 2 shows certain components located in particular locations, such as the pistol grip 104, the disclosed embodiments support placement of said components in any location within or without the firearm.

Figure 3:
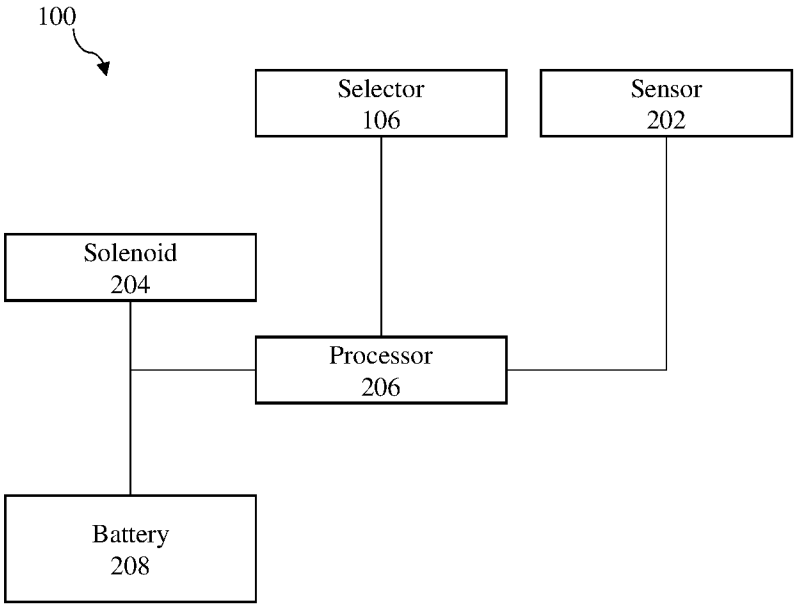
FIG. 3 is a block diagram showing the functional relationship between the internal components of a system for aiding the rapid sequential firing of a semi-automatic weapon, according to another example embodiment.

FIG. 3 is a block diagram showing the functional relationship between the internal components of the system 100 for aiding the rapid sequential firing of a semi-automatic weapon, according to another example embodiment. FIG. 2 shows that the processor 206 is conductively coupled with the selector 106 so as to detect the current mode of the weapon and conductively coupled with the sensor 202 so as to receive sensor data regarding the current state of the weapon. The processor 206 is also conductively coupled with the solenoid 204 so as to activate movement of the plunger 110 in relation to the trigger 108.

In one embodiment, the sensor 202 includes a forward switch that is depressed by the bolt of the weapon as it reaches the rearward end of its stroke during normal cycling of the weapon. The depression of the forward switch results in the sensor 202 sending a signal to the processor 206, or alternatively, ceasing the sending of a signal that was previously being sent. The processor 206 detects this signal (or lack of signal) and acts accordingly, as described in more detail above and below. Once said forward switch is released as the bolt begins moving forward to chamber a new round, this results in the sensor 202 sending a signal to the processor 206, or alternatively, ceasing the sending of a signal that was previously being sent. The processor 206 detects this signal (or lack of signal) and acts accordingly, as described in more detail above and below.

In one alternative, the sensor 202 also includes a second switch placed in the rear of the sensor 202 which is depressed by the downward-facing rearward part of the bolt as it moves into battery. Once the bolt is in battery, the firearm is ready to fire again. The depression of the second switch sends a signal to the processor 206 (or alternatively ceases sending a signal). The processor 206 detects this signal (or lack of signal) and acts accordingly, such as setting a timer, retracting the plunger or removing force on the plunger. Subsequently, this allows the shooter to fire the weapon again and resets the processor 206 so it is ready for another cycle.

Another alternative eliminates the second switch and uses a timing device instead. A predefined period of time (that corresponds to the particular weapon) may be used to time the forward position of the bolt in battery. For example, an average AR15 takes about 20 milliseconds from the point where the forward switch is released until the bolt is in battery. In this embodiment, a simple timing circuit may be used to monitor or detect the passage of a predefined period of time (such as 20 milliseconds in the AR15 example above, with an extra 5 milliseconds for safety and reliability) each time the forward switch is released, so as to determine when to turn on the solenoid. Therefore, the timing circuit is used to determine (based on the predefined period of time that corresponds to the particular weapon) when the bolt is ready to fire again. Depending on the embodiment, the device can include means for the user to adjust said predefined period of time, allowing he or she to better adapt the device to their particular weapon.

Note that although FIG. 3 shows certain components coupled in particular arrangements, the disclosed embodiments support any arrangement or coupling of said components in any location within or without the firearm.

Figure 4:
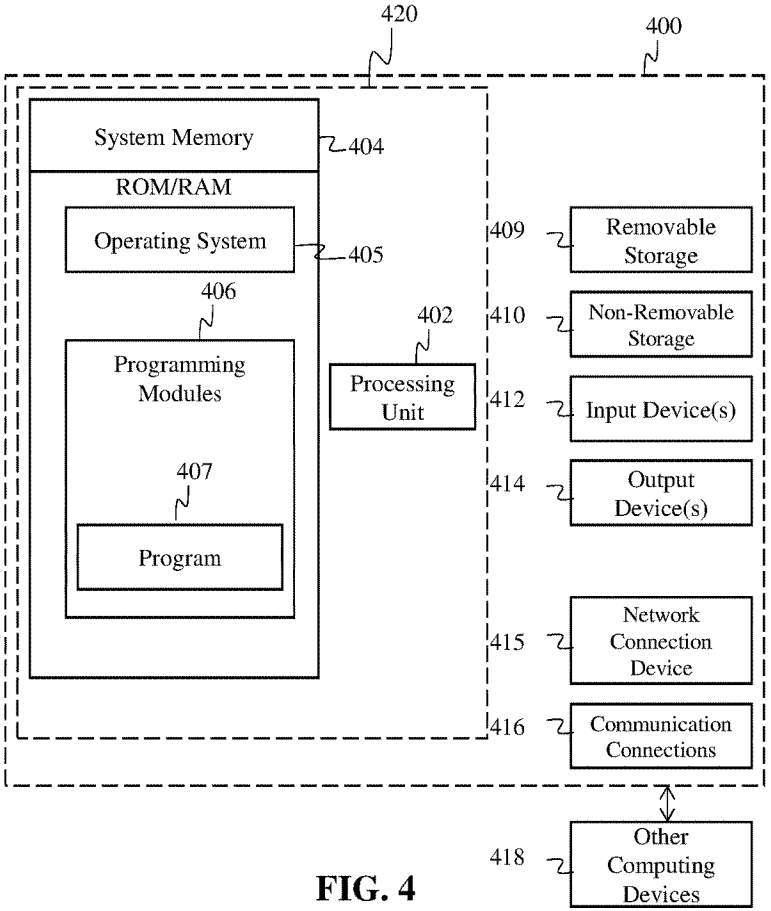
FIG. 4 is a block diagram of a computer system useful for implementing the example embodiments disclosed herein.

FIG. 4 is a block diagram of a computer system useful for implementing the example embodiments disclosed herein. Consistent with the embodiments described herein, the aforementioned actions performed by processor 206 may be implemented in a computing device, such as the computing device 400 of FIG. 4. Any suitable combination of hardware, software, or firmware may be used to implement the computing device 400. The aforementioned system, device, and processors are examples and other systems, devices, and processors may comprise the aforementioned computing device.

With reference to FIG. 4, a system consistent with an embodiment of the claimed subject matter may include a plurality of computing devices, such as computing device 400. In a basic configuration, computing device 400 may include at least one processing unit 402 and a system memory 404. Depending on the configuration and type of computing device, system memory 404 may comprise, but is not limited to, volatile (e.g. random access memory (RAM)), non-volatile (e.g. read-only memory (ROM)), flash memory, or any combination or memory. System memory 404 may include operating system 405, and one or more programming modules 406. Operating system 405, for example, may be suitable for controlling computing device 400's operation. In one embodiment, programming modules 406 may include, for example, a program module 407 for executing the actions of processor 206. This basic configuration is illustrated in FIG. 4 by those components within a dashed line 420.

Computing device 400 may have additional features or functionality. For example, computing device 400 may also include additional data storage devices (removable and/or non-removable) such as, for example, magnetic disks, optical disks, or tape. Such additional storage is illustrated in FIG. 4 by a removable storage 409 and a non-removable storage 410. Computer storage media may include volatile and nonvolatile, removable and non-removable media implemented in any method or technology for storage of information, such as computer readable instructions, data structures, program modules, or other data. System memory 404, removable storage 409, and non-removable storage 410 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 400. Any such computer storage media may be part of device 400. Computing device 400 may also have input device(s) 412 and output device(s) 414. The aforementioned devices are only examples, and other devices may be added or substituted.

Computing device 400 may also contain a network connection device 415 that may allow device 400 to communicate with other computing devices 418, such as over a network in a distributed computing environment, for example, an intranet or the Internet. Device 415 may be a wired or wireless network interface controller, a network interface card, a network interface device, a network adapter or a LAN adapter. Device 415 allows for a communication connection 416 for communicating with other computing devices 418. Communication connection 416 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 404, including operating system 405. While executing on processing unit 402, programming modules 406 (e.g. program module 407) may perform processes including, for example, one or more of the stages of the processor 206 as described above. The aforementioned processes are examples, and processing unit 402 may perform other processes.

Generally, consistent with embodiments of the claimed subject matter, program modules may include routines, programs, components, data structures, and other types of structures that may perform particular tasks or that may implement particular abstract data types. Moreover, embodiments may be practiced with other computer system configurations, including hand-held devices, multiprocessor systems, microprocessor-based or programmable consumer electronics, minicomputers, mainframe computers, and the like. Embodiments may also be practiced in distributed computing environments where tasks are performed by remote processing devices that are linked through a communications network. In a distributed computing environment, program modules may be located in both local and remote memory storage devices.

Furthermore, embodiments may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments may also be practiced using other technologies capable of performing logical operations such as, for example, AND, OR, and NOT, including but not limited to mechanical, optical, fluidic, and quantum technologies. In addition, embodiments may be practiced within a general purpose computer or in any other circuits or systems.

While certain embodiments have been described, other embodiments may exist. Furthermore, although embodiments have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the claimed subject matter.

Figure 5A:
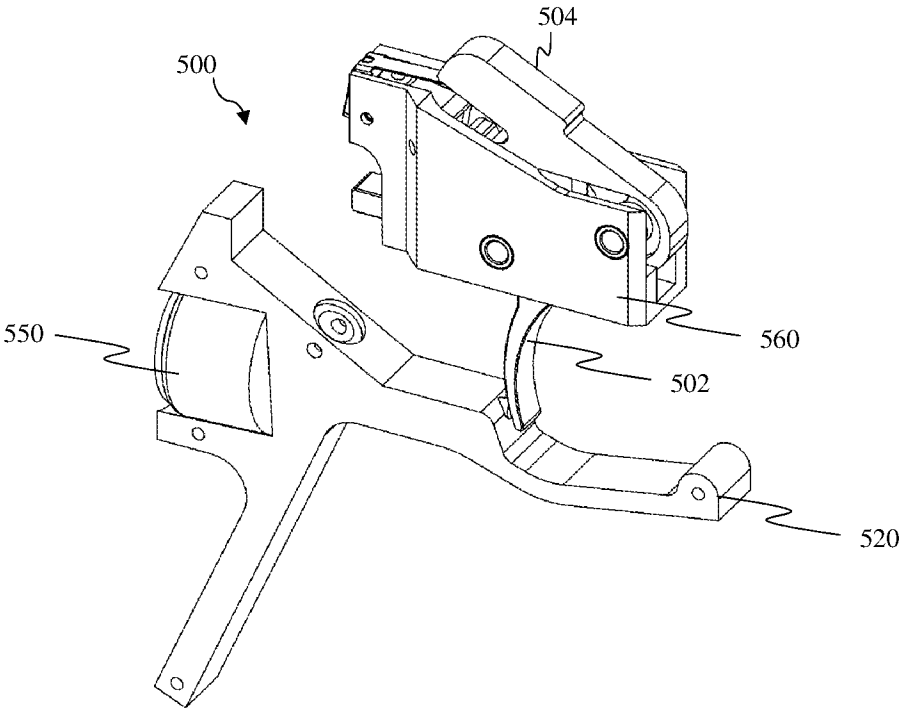
FIG. 5A is a right side perspective view of the claimed device in its original position or unfired position, according to one embodiment.
Figure 5B:
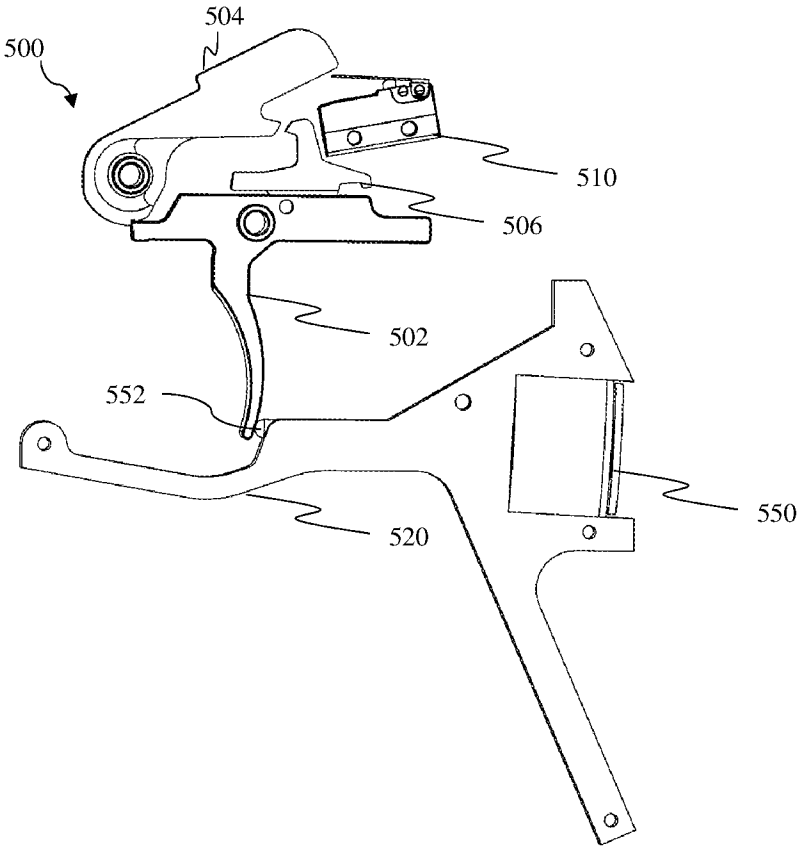
FIG. 5B is a left side view of the claimed device in its original position or unfired position, according to one embodiment.
Figure 5C:
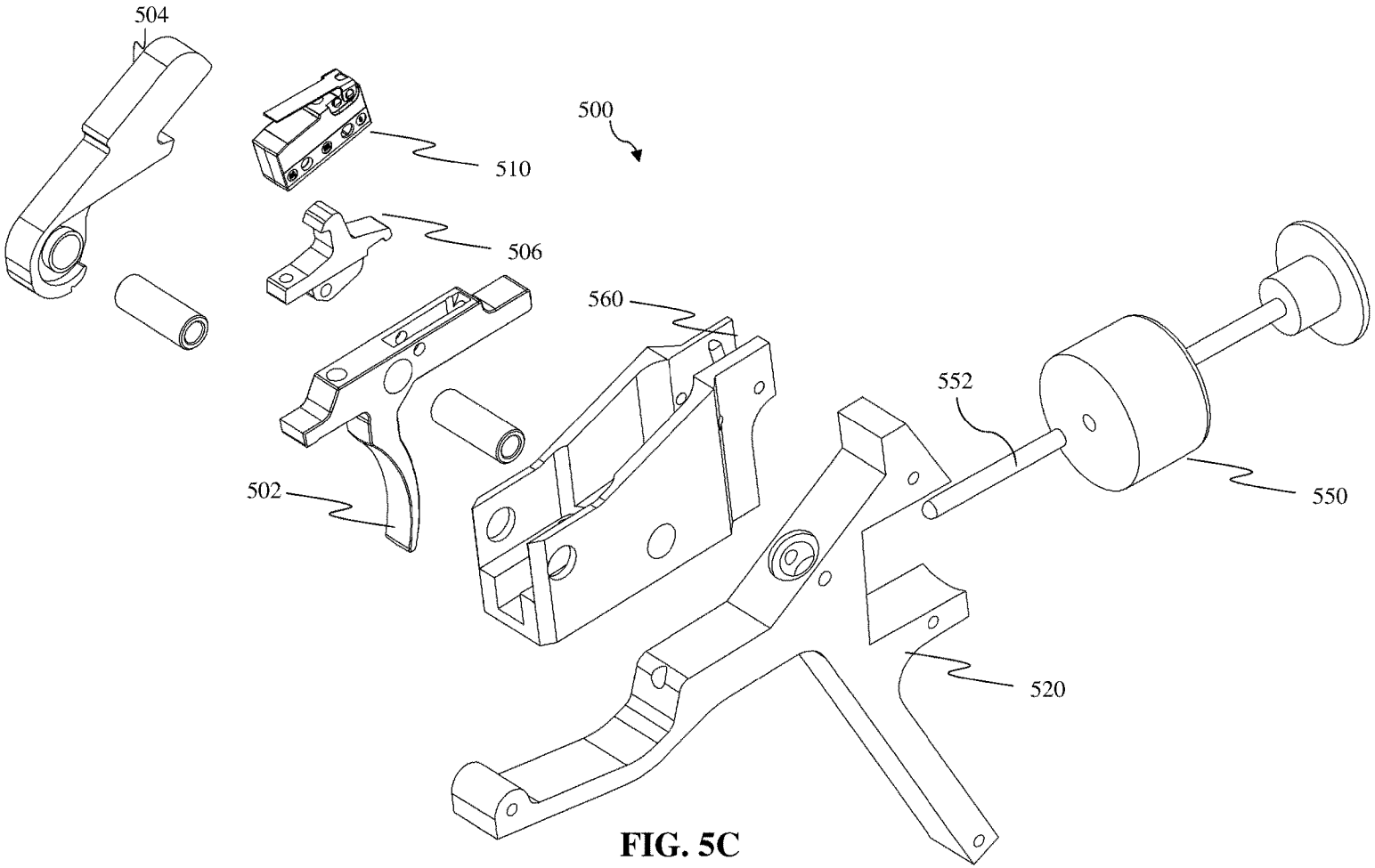
FIG. 5C is a left side perspective and exploded view of the claimed device, according to one embodiment.

FIG. 5A is a right side perspective view of the claimed device 500 in its original position or unfired position, according to one embodiment. FIGS. 5A-5C show the device 500 in the unfired position wherein the hammer 504 is engaged or held secure by the trigger 502 and which is fully extended forward and ready to be depressed by the user. FIG. 5B is a left side view of the claimed device in its original position or unfired position, according to one embodiment. FIGS. 5A-5C show the frame 520 that serves as the base for the solenoid 550 and plunger 552. FIGS. 5A-5C also show the sensor 510 located behind the trigger group, wherein the sensor is configured to transmit a signal depending on the position of the hammer The sensor may be a touch or contact sensor that emits a signal when an appendage of the sensor has been moved a particular distance or a minimum distance by an external force. FIGS. 5A and 5C show the housing 560 used to serve as a base for the trigger 502, disconnector 506, hammer 504 and sensor 510. Not shown is a control circuit conductively coupled with the sensor (such as processor 206), the battery (208) and the solenoid (204), wherein the control circuit is configured to receive said signal from the sensor, determine, based on said signal, when the solenoid must be activated, and activate current from the battery to the solenoid so as to move the plunger to the first position, thereby moving the trigger into the unfired position. FIG. 5C is a left side perspective and exploded view of the claimed device, according to one embodiment.

Figure 6A:
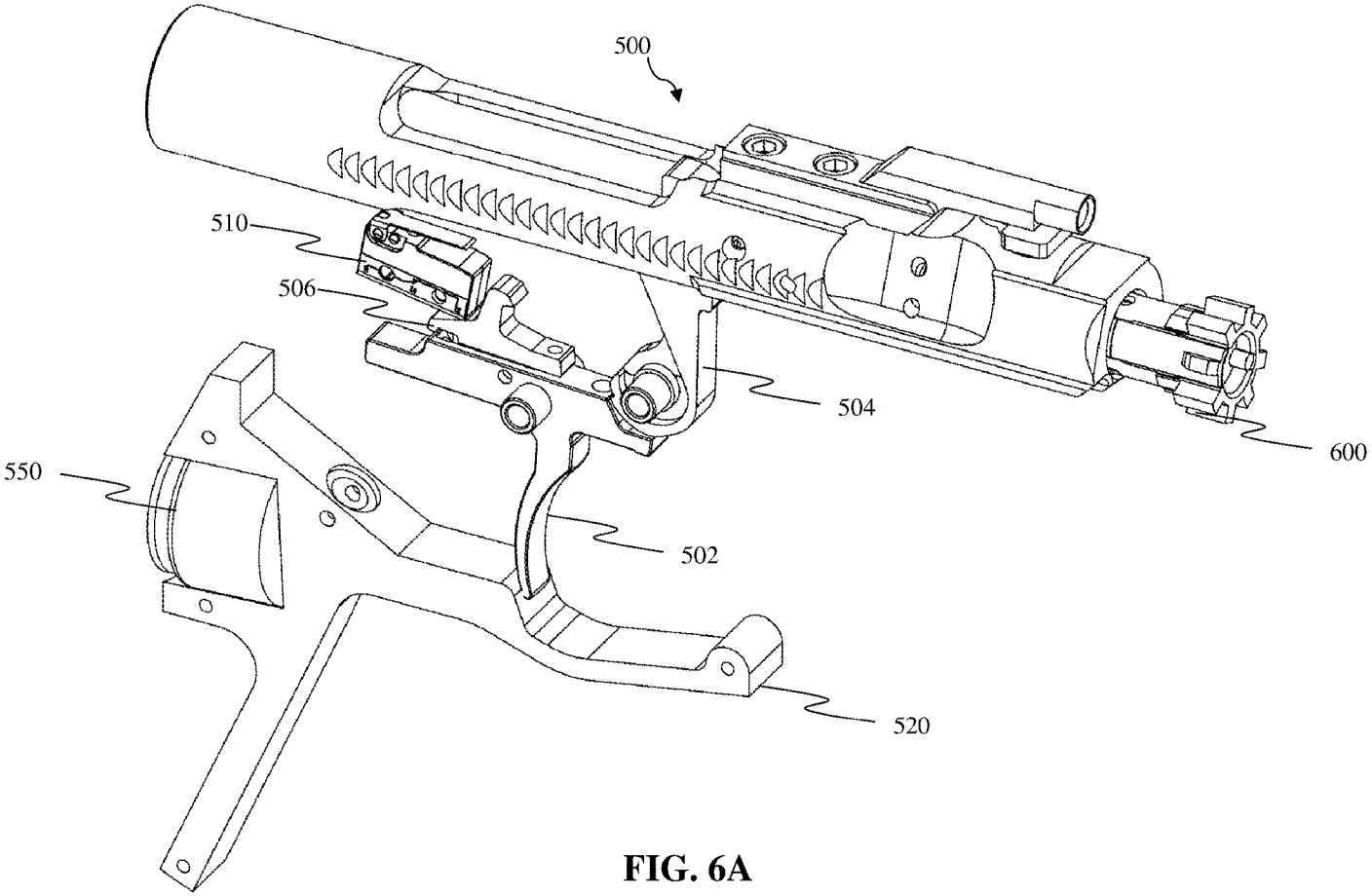
FIG. 6A is a right side perspective view of the claimed device in the "fired" position, according to one embodiment.
Figure 6B:
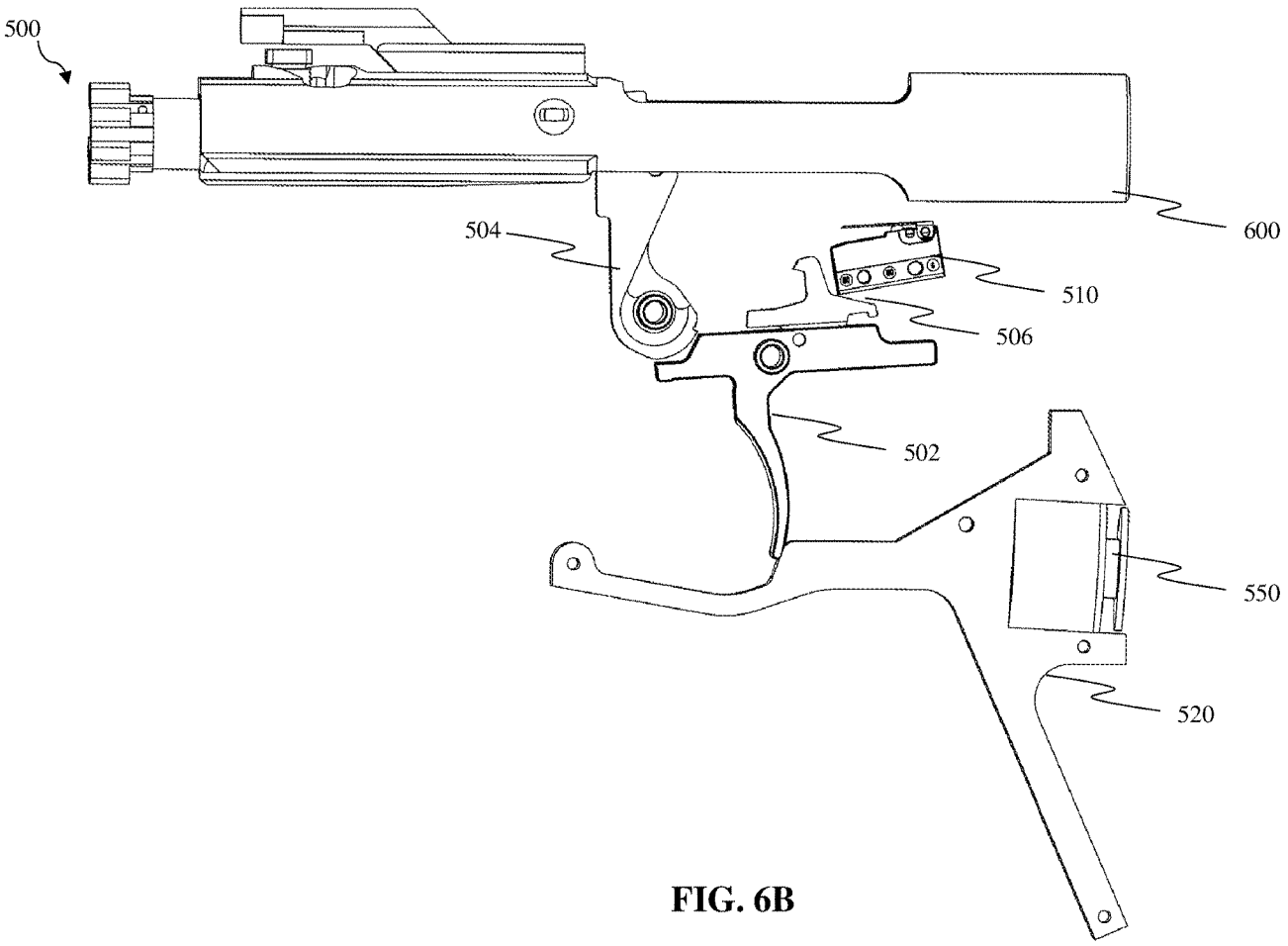
FIG. 6B is a left side view of the claimed device in the "fired" position, according to one embodiment.
Figure 6C:
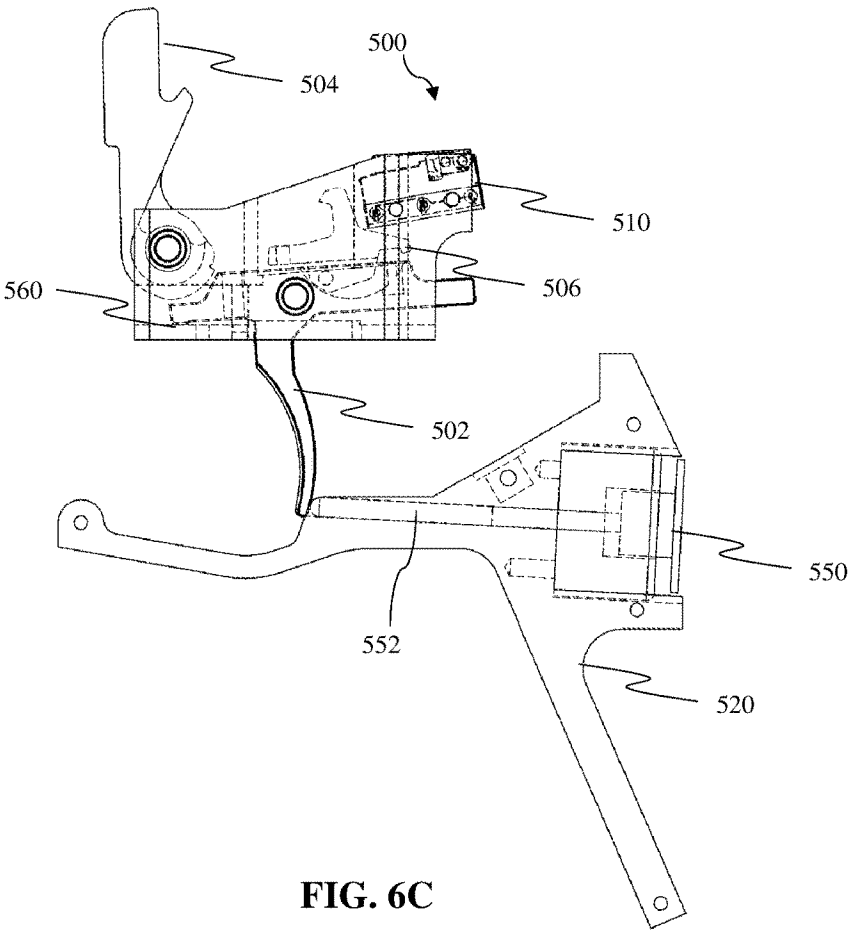
FIG. 6C is a left side view of the claimed device in the "fired" position, showing a housing for certain internal components, according to one embodiment.

FIG. 6A is a right side perspective view of the claimed device in the "fired" position, according to one embodiment. FIGS. 6A-6C show the device 500 in the "fired" position wherein the trigger 502 has been pulled as far back as possible until it releases the hammer 504, hammer 504 has travelled forward under spring force so as to contact or strike the firing pin, which fires the round that has been chambered by the bolt 600. FIG. 6B is a left side view of the claimed device in the "fired" position, according to one embodiment. FIG. 6C is a left side view of the claimed device in the "fired" position, showing a housing for certain internal components, according to one embodiment. FIGS. 6A-6C show that in the fired position, the plunger has no force applied to it and may simply be retracted and not in use.

Figure 7A:
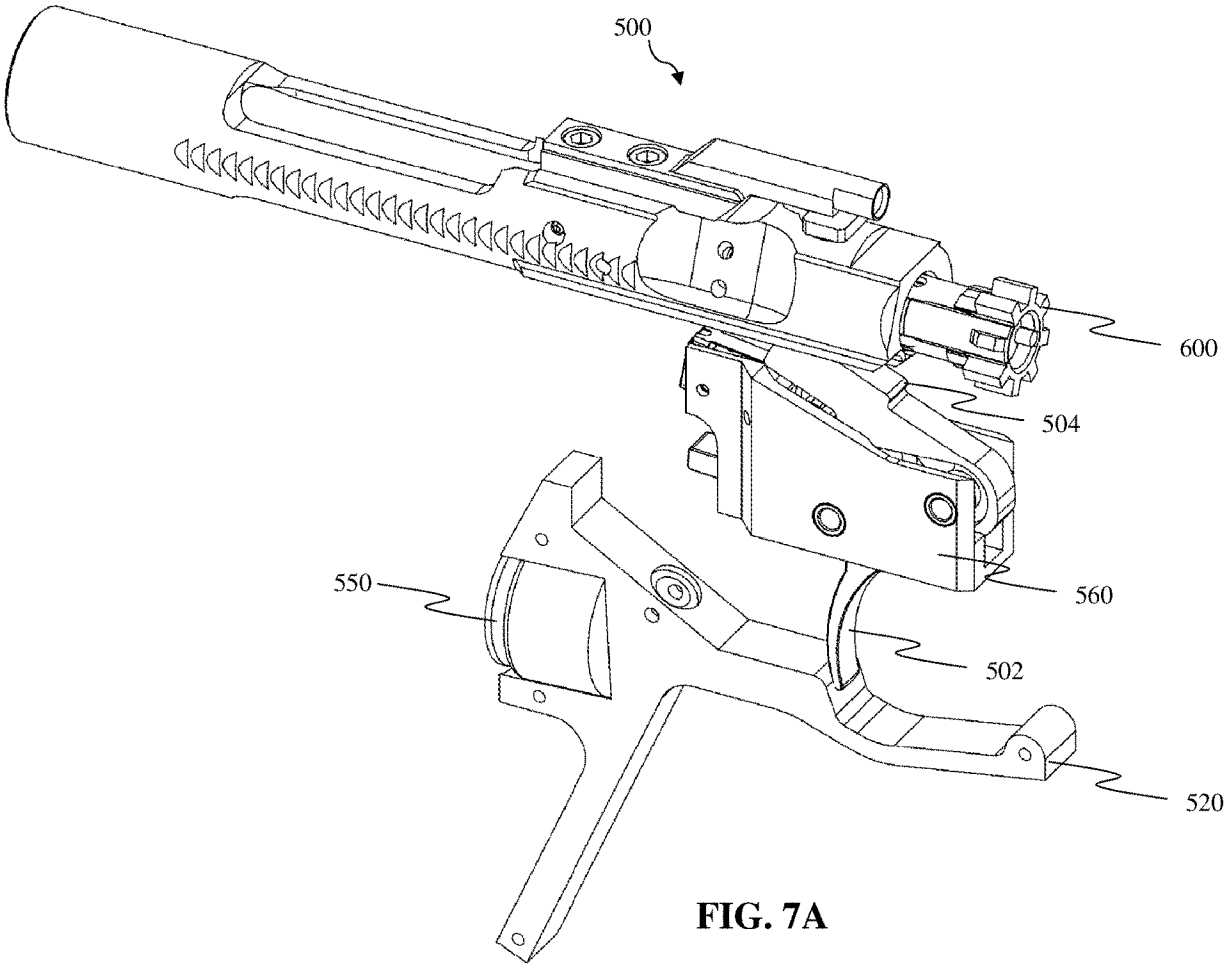
FIG. 7A is a right side perspective view of the claimed device in the "past disconnector" position, according to one embodiment.
Figure 7B:
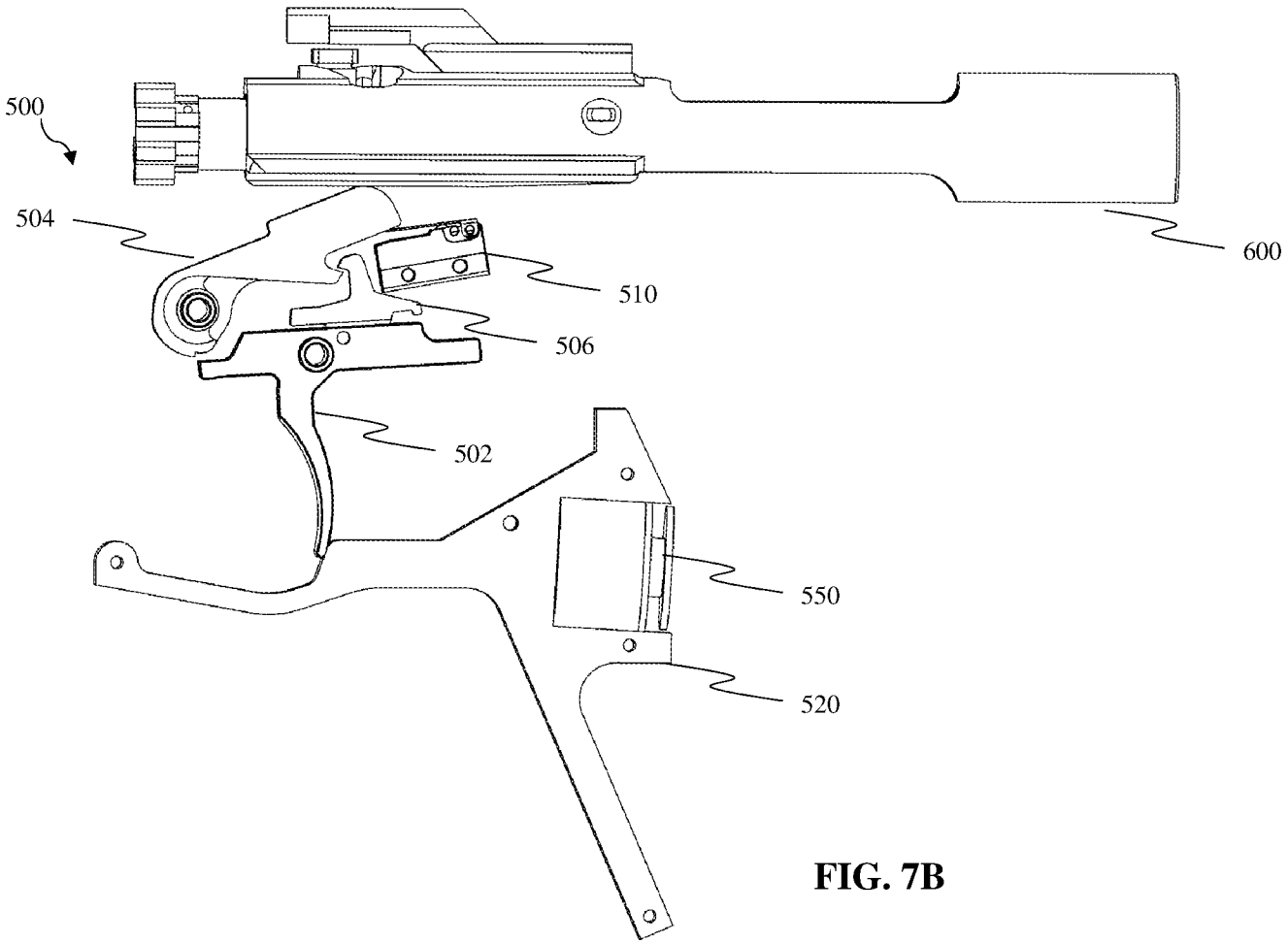
FIG. 7B is a left side view of the claimed device in the "past disconnector" position, according to one embodiment.

FIG. 7A is a right side perspective view of the claimed device in the "past disconnector" position, according to one embodiment. FIGS. 7A-7B show the device 500 in the "past disconnector" or in-transit position wherein the bolt 600 has travelled as far back as possible under recoil of the firing of the round, the hammer 504 has been pushed back past the disconnector 506 by the bolt (though the disconnector has not yet captured the hammer), and the hammer has engaged the sensor 510. FIG. 7B is a left side view of the claimed device in the "past disconnector" position, according to one embodiment. When the hammer has engaged the sensor 510, the sensor may commence sending a signal, preferably to the processor 206. In another alternative, when the hammer has engaged the sensor 510, the sensor may stop sending a signal to the processor 206. Either way, when the processor 206 receives the signal from the sensor (or detects the ceasing of the sending of a signal), the processor 206 initiates an action.

Note that sensor 510 acts as a means for detecting that the bolt has translated rearwardly at least a first predetermined distance due to firing the firearm. Although sensor 510 is disclosed as a touch or contact sensor, other sensors may be used, such as a chemical sensor, a magnetic sensor, a tilt sensor, a magnetic pendulum sensor, an accelerometer, or the like. Also, the means for detecting that the bolt has translated rearwardly at least a first predetermined distance may be, for example, a sensor that detects the location of the bolt, a timer that starts when the trigger is pulled or the hammer contacts the firing pin, or the like.

Figure 8A:
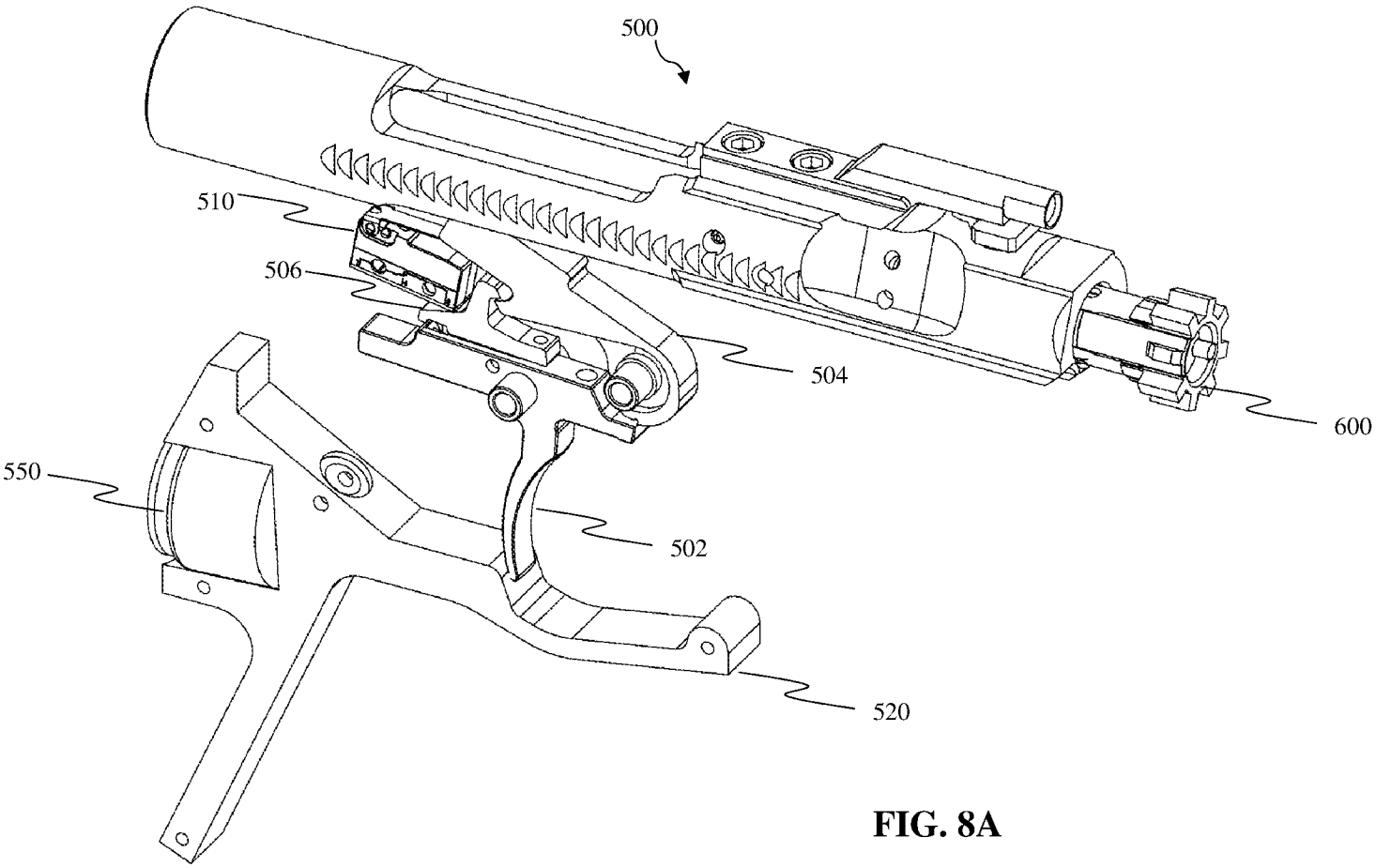
FIG. 8A is a right side perspective view of the claimed device in the "disconnector engaged" position, according to one embodiment.
Figure 8B:
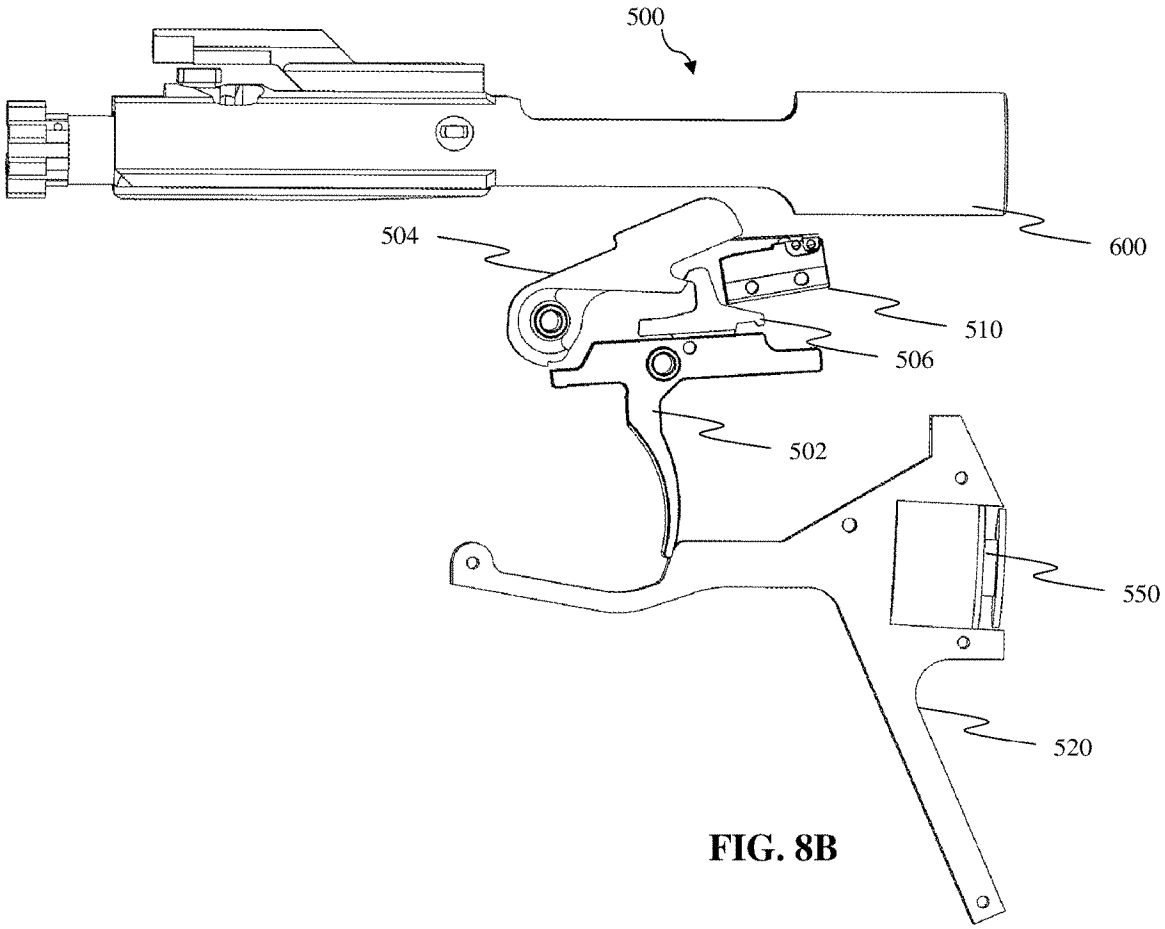
FIG. 8B is a left side view of the claimed device in the "disconnector engaged" position, according to one embodiment.

FIG. 8A is a right side perspective view of the claimed device in the "disconnector engaged" position, according to one embodiment. FIGS. 8A-8B show the device 500 in the "disconnector engaged" position wherein the bolt 600 has now travelled forward under spring force after firing of the round, the hammer 504 has been pulled back past the disconnector 506 by the bolt and, as the bolt has now returned to its forward position, the disconnector 506 has now captured the hammer, and the hammer no longer engages the sensor 510 past the activation parameter of the sensor. FIG. 8B is a left side view of the claimed device in the "disconnector engaged" position, according to one embodiment. Since the hammer no longer engages the sensor 510 past the activation parameter of the sensor, the sensor ceases sending a signal (or in the alternative, begins sending a signal) to the processor. Once the processor detects that the signal from the sensor has ceased being emitted (or, alternatively, a signal starts being sent), the processor may engage a timer or a timing circuit to mark the passage of a predetermined amount of time, which may be between 15-60 milliseconds. Once the processor has determined that the predetermined amount of time has passed, the processor activates current from the battery to the solenoid to move the plunger forward and reset the trigger to its original unfired position. Note that sensor 510 is disclosed as a means for detecting when the bolt has translated forwardly a second predetermined distance after the bolt has translated rearwardly. Thus, by no longer activating the sensor 510, the bolt has, as this juncture, moved forward a second predetermined distance, which indicates that the next bullet will be chambered in a given amount of time.

Note that the 15-60 millisecond wait time has been identified, as a result of experimental activities, as the optimum amount of time it takes for the next round to be chambered, after the bolt 600 has travelled away from the hammer, and the hammer no longer engages the sensor 510 past the activation parameter of the sensor. That is, once the movement of the bolt no longer activates the sensor, the 15-60 millisecond wait time is the optimum amount of time it takes for the next round to be chambered. This ensures that once the plunger rests the trigger, the next round has already been chambered and there is no chance that the hammer will fall while the bolt is out of battery.

Note that the means for calculating a particular time when the bolt will be in a chambered position, responsive to detecting that the bolt has translated rearwardly at least the first predetermined distance, is disclosed as the processor 206 utilizing a timer or timing circuit. The claimed subject matter, however, supports the use of other means for calculating a particular time when the bolt will be in a chambered position, such as the use of a mechanical timer, an electromechanical timer, an electronic timer, or a software application executing on a computing device 400.

Note also that the plunger 110 is disclosed as the means for applying a forward biasing force to translate the trigger from a fired to an un-fired position, at the particular time the bolt is in the chambered position. Other means, however, may be used to apply a forward biasing force to translate the trigger from a fired to an un-fired position, at the particular time the bolt is in the chambered position. For example, a lever or beam may place a force on the trigger 502, a gear may turn or rotate the trigger 502, a rubber band or belt may place a force on the trigger 502, or the like. Note also that immediately after placing the trigger in an un-fired position, the forward biasing force is removed by the processor.

In an alternative embodiment of the claimed subject matter, responsive to detecting when the bolt has translated rearwardly at least a first predetermined distance due to firing the firearm (as disclosed above), the processor 206 activates the means for applying a forward biasing force to translate the trigger from a fired to an un-fired position. At this juncture, the forward biasing force is continuously applied to the trigger until it is removed. In one embodiment, the forward biasing force applied to the trigger may be so high that it withstands the trigger being pulled by a human, such as a force of 20 pounds.

Subsequently, in this alternative embodiment, a means for detecting when the bolt has translated forwardly into a chambered position detects the bolt has entered into the chambered position. Said means for detecting when the bolt has translated forwardly into a chambered position may comprise a sensor (such as any of the sensors disclosed herein) or the use of a timer or timing circuit by the processor 206 to measure the amount of time it takes the next round to enter the chamber. Subsequently, once the processor 206 detects that the next round is in the chamber, the processor 206 remove said forward biasing force, thereby allowing the trigger to be pulled.

Figure 9A:
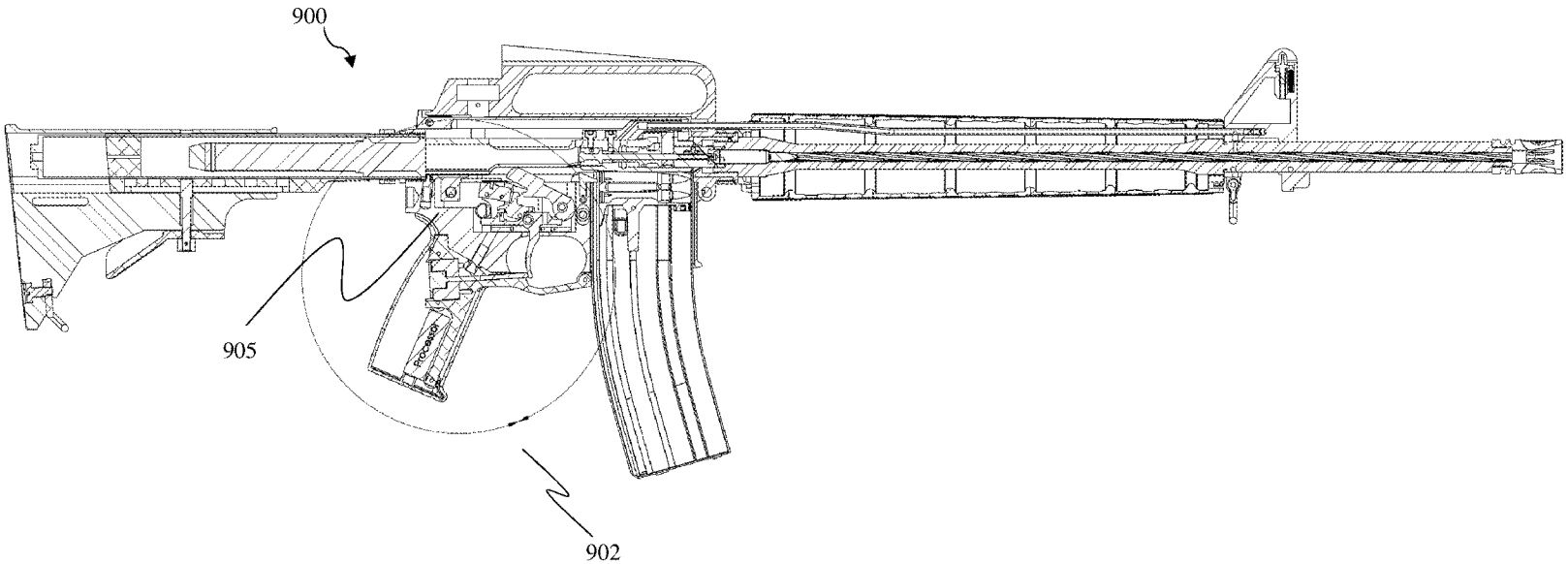
FIG. 9A is an illustration of a side view of the claimed device installed in an AR-15 semiautomatic firearm, according to one embodiment.
Figure 9B:
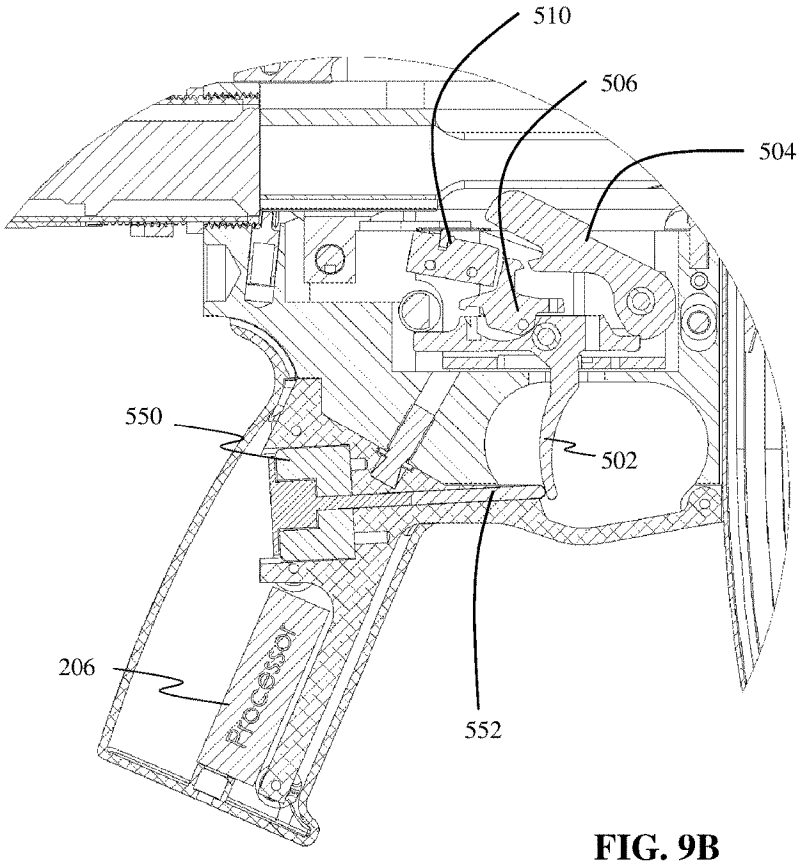
FIG. 9B is a close-up of a portion of the illustration of FIG. 9A.
Figure 9C:
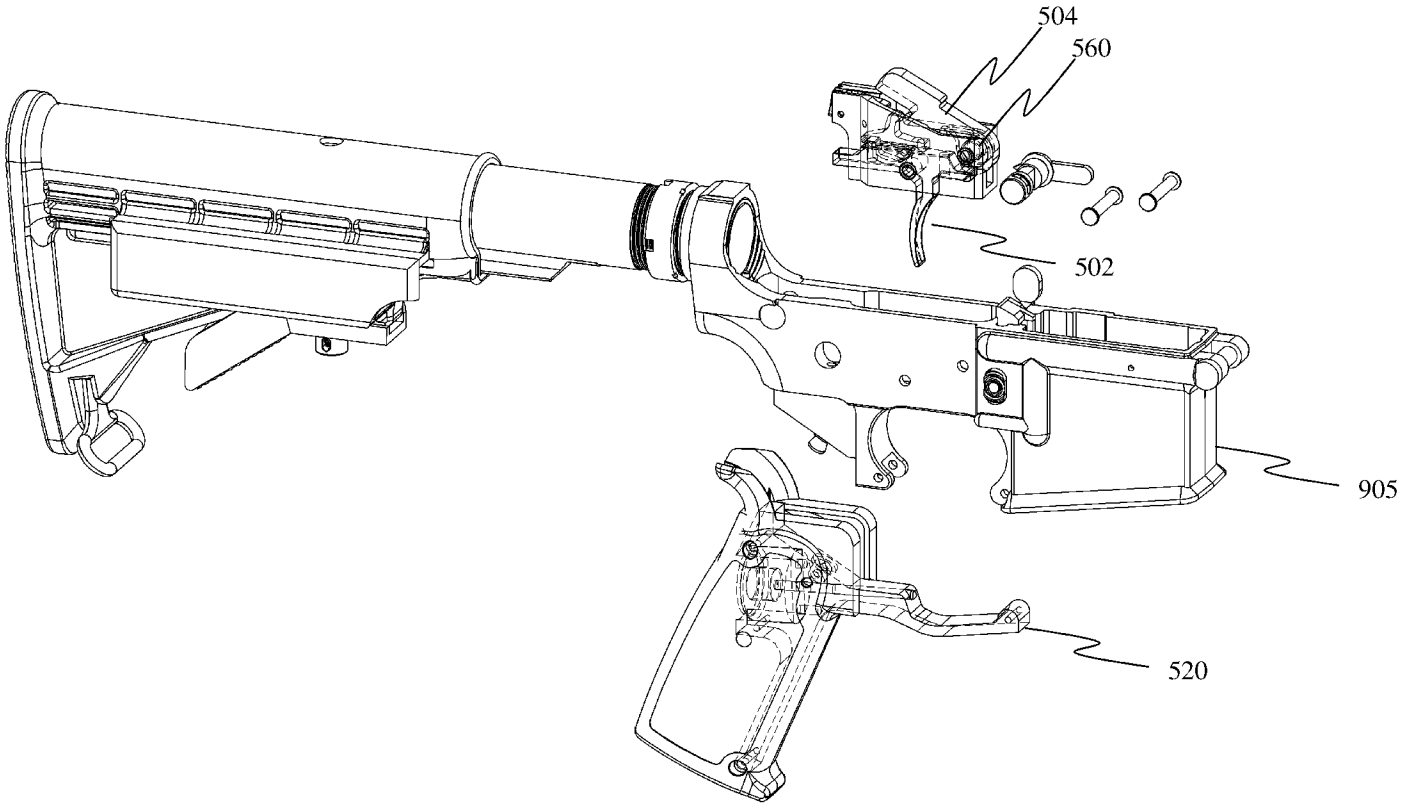
FIG. 9C is an illustration of an exploded view of a portion of the claimed device installed in an AR-15 semiautomatic firearm, according to one embodiment.
Figure 9D:
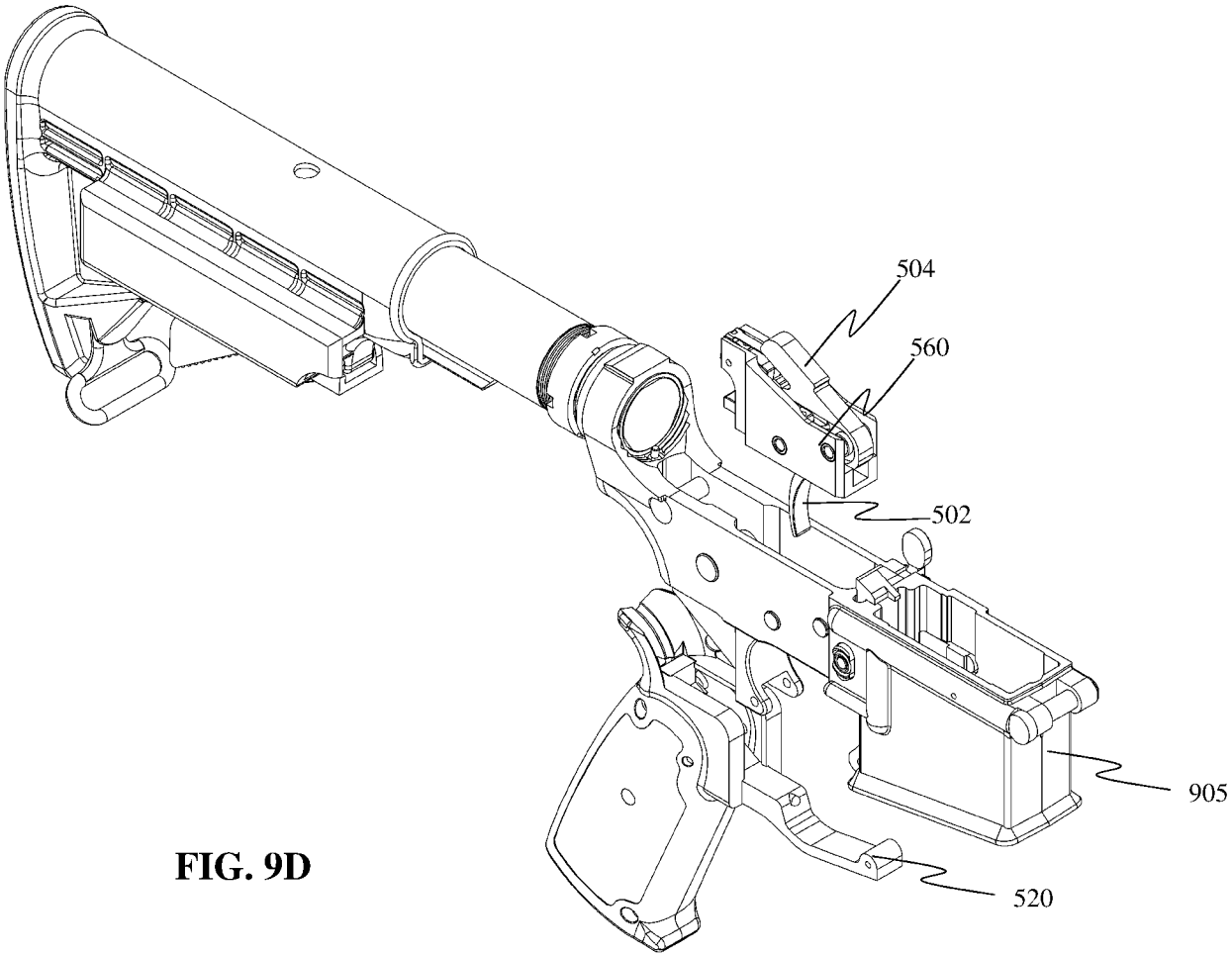
FIG. 9D is a perspective view of the illustration of FIG. 9C.

FIG. 9A is an illustration of a side view of the claimed device installed in an AR-15 semiautomatic firearm 900, according to one embodiment. FIG. 9A shows that the claimed device may be installed in the receiver 905 of an AR-15 semiautomatic firearm 900, wherein a detailed portion 902 is shown in greater detail in FIG. 9B. FIG. 9B is a close-up of the portion 902 of the illustration of FIG. 9A. FIG. 9B shows the location of the sensor 510, disconnector 506, hammer 504, trigger 502, plunger 552, and processor 206 in the firearm 900. FIG. 9C is an illustration of an exploded view of a portion of the claimed device installed in an AR-15 semiautomatic firearm 900, according to one embodiment. FIG. 9C shows the location of the housing 560 in the receiver 905, as well as the frame 520. FIG. 9D is a perspective view of the illustration of FIG. 9C.

Figure 10:
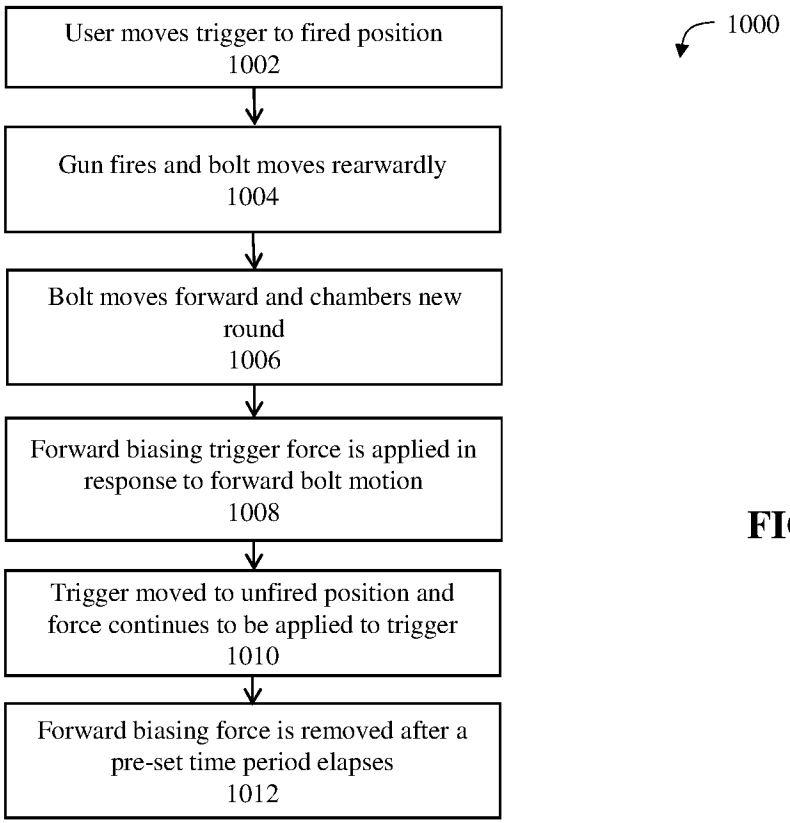
FIG. 10 is a flowchart showing one aspect of the operation of one embodiment of the system for aiding the rapid sequential firing of a semi-automatic weapon.

FIG. 10 is a flowchart 1000 showing one aspect of the operation of one embodiment of the system for aiding the rapid sequential firing of a semi-automatic weapon. FIG. 10 is a general representation of the process by which the device 100 operates, in an embodiment where force is applied to the trigger after the bolt is in battery. The flowchart 1000 begins with step 1002, wherein the user moves the trigger 502 to a fired position. In step 1004, the gun fires and the bolt 600 moves rearwardly. Then, in step 1006, the bolt 600 moves forward and chambers a new round. In step 1008, responsive to the forward motion of the bolt 600 (such as via detection by processor 206 via sensor 202 or 510), the forward biasing force is applied by the plunger 552 to the trigger 502 (by activation of the solenoid 550 by the processor 206). In step 1008, the forward motion of the bolt may enable the processor 206 to start a timer or timing circuit. In step 1010, the trigger 502 is moved to the unfired position and the forward biasing force continues to be applied by the plunger 552 to the trigger 502. In step 1012, after a pre-set period of time has elapsed (such as via said timer or timing circuit), the forward biasing force applied by the plunger 552 to the trigger 502 is removed.

Figure 11:
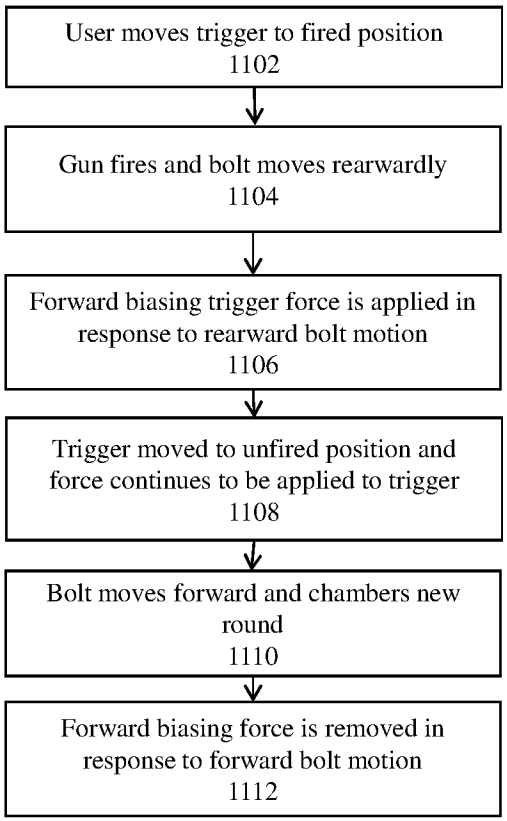
FIG. 11 is a flowchart showing another aspect of the operation of another embodiment of the system for aiding the rapid sequential firing of a semi-automatic weapon.

FIG. 11 is a flowchart 1100 showing another aspect of the operation of another embodiment of the system for aiding the rapid sequential firing of a semi-automatic weapon. FIG. 11 is a general representation of the process by which the device 100 operates, in an embodiment where the forward biasing force is applied as the bolt 600 travels back and is removed as the bolt 600 goes into battery. The flowchart 1100 beings with step 1102, wherein the user moves the trigger 502 to a fired position. In step 1104, the gun fires and the bolt 600 moves rearwardly. In step 1104, the rearward motion of the bolt may enable the processor 206 to start a timer or timing circuit. In step 1106, responsive to the rearward motion of the bolt 600 (such as via detection by processor 206 via sensor 202 or 510), the forward biasing force is applied by the plunger 552 to the trigger 502 (by activation of the solenoid 550 by the processor 206). In step 1108, the trigger 502 is moved to the unfired position and the forward biasing force continues to be applied by the plunger 552 to the trigger 502. In step 1110, the bolt moves forward and chambers a new round. In step 1112, responsive to the forward motion of the bolt 600, the forward biasing force applied by the plunger 552 to the trigger 502 is removed.

Figure 12:
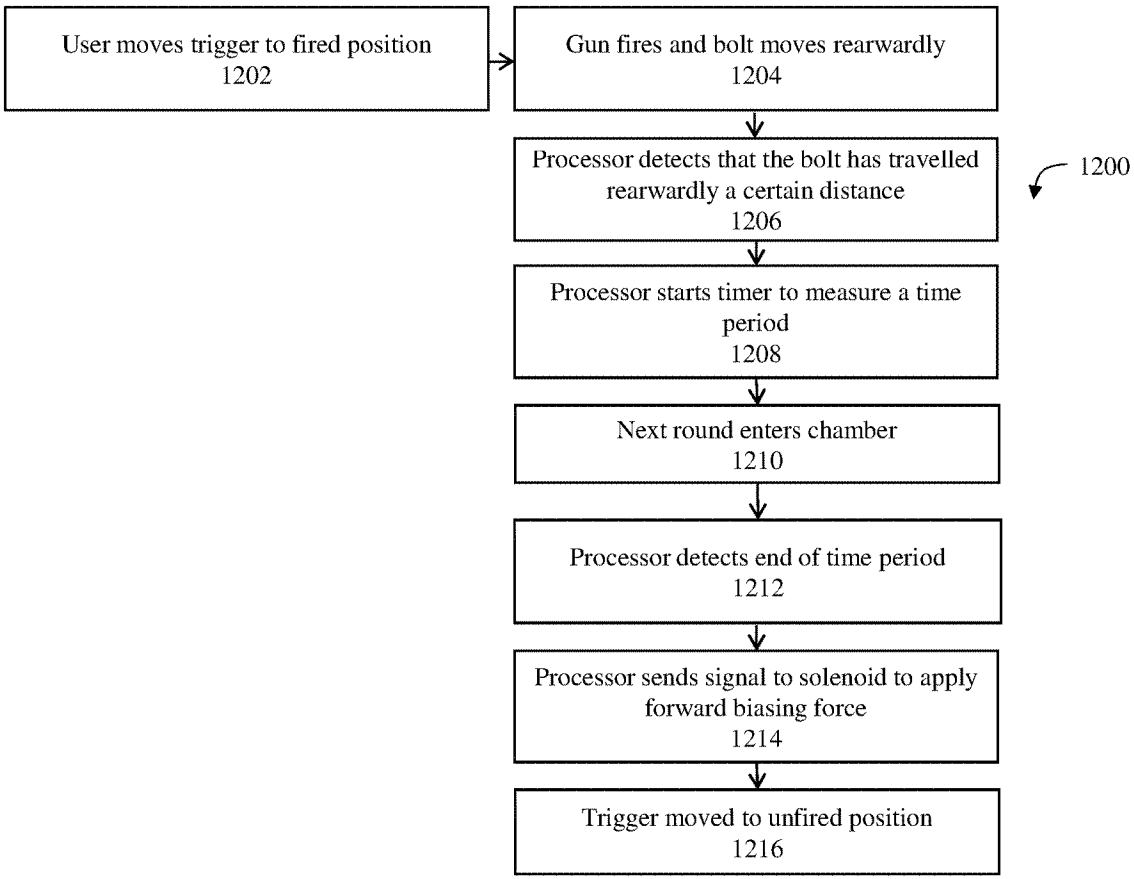
FIG. 12 is a flowchart showing another aspect of the operation of another embodiment of the system for aiding the rapid sequential firing of a semi-automatic weapon.

FIG. 12 is a flowchart 1200 showing another aspect of the operation of another embodiment of the system for aiding the rapid sequential firing of a semi-automatic weapon. FIG. 12 is a more specific representation of the process outlined in FIG. 10 that shows the role of the processor and timer in said process. The flowchart 1200 beings with step 1202, wherein the user moves the trigger 502 to a fired position. In step 1204, the gun fires and the bolt 600 moves rearwardly. In step 1206, the processor 206 detects (such as via detection by processor 206 via sensor 202 or 510) that the bolt 600 has moved rearwardly a certain distance. In step 1208, the processor 206 starts a timer or timing circuit. Then, in step 1210, the bolt 600 moves forward and chambers a new round. In step 1212, the processor 206 detects that a pre-set period of time has elapsed (such as via said timer or timing circuit). In step 1214, the processor sends a signal to the solenoid 550 to apply a forward biasing force via plunger 552. In step 1216, the forward biasing force is applied by the plunger 552 to the trigger 502 (by activation of the solenoid 550 by the processor 206) and the trigger 502 is moved to the unfired position.

Figure 13:
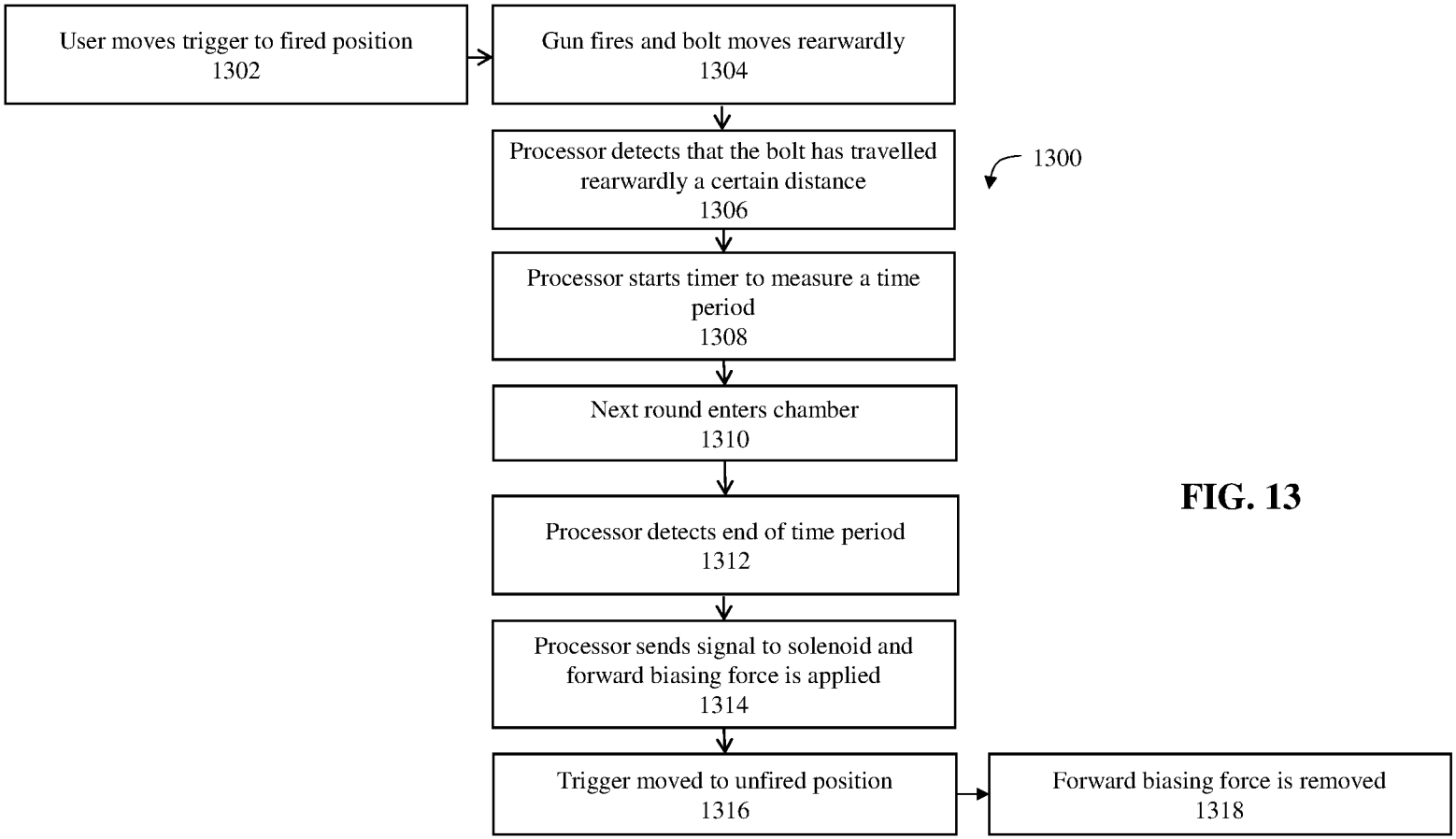
FIG. 13 is a flowchart showing another aspect of the operation of another embodiment of the system for aiding the rapid sequential firing of a semi-automatic weapon.

FIG. 13 is a flowchart 1300 showing another aspect of the operation of another embodiment of the system for aiding the rapid sequential firing of a semi-automatic weapon. The process of FIG. 13 is a small variation of the process of FIG. 12. The flowchart 1300 begins with step 1302, wherein the user moves the trigger 502 to a fired position. In step 1304, the gun fires and the bolt 600 moves rearwardly. In step 1306, the processor 206 detects (such as via detection by processor 206 via sensor 202 or 510) that the bolt 600 has moved rearwardly a certain distance. In step 1308, the processor 206 starts a timer or timing circuit. Then, in step 1310, the bolt 600 moves forward and chambers a new round. In step 1312, the processor 206 detects that a pre-set period of time has elapsed (such as via said timer or timing circuit). In step 1314, the processor sends a signal to the solenoid 550 to apply a forward biasing force via plunger 552. In step 1316, the forward biasing force is applied by the plunger 552 to the trigger 502 (by activation of the solenoid 550 by the processor 206) and the trigger 502 is moved to the unfired position. In step 1318, the forward biasing force is removed by the processor 206 by sending an appropriate signal to the solenoid.

Figure 14:
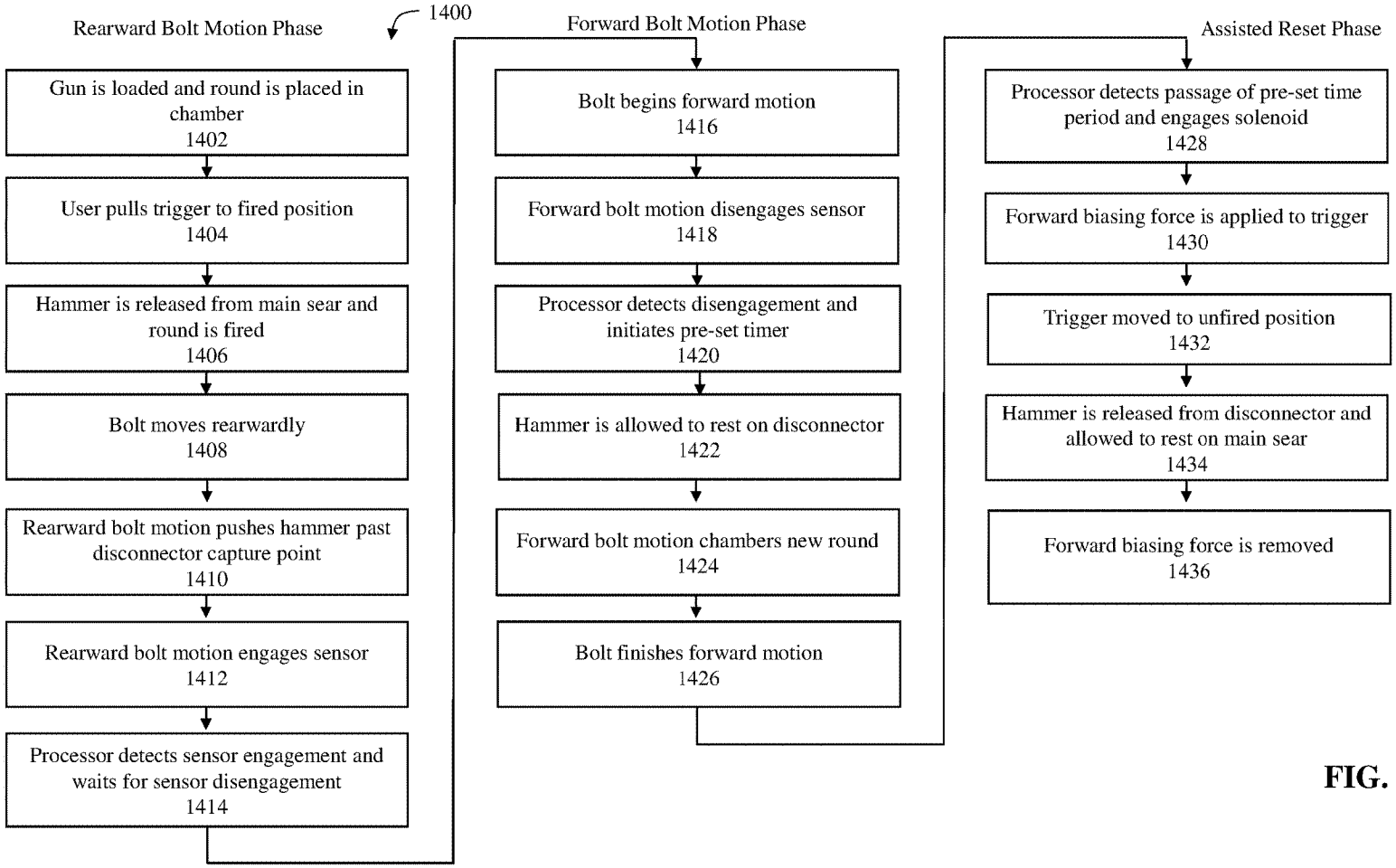
FIG. 14 is a flowchart showing another aspect of the operation of another embodiment of the system for aiding the rapid sequential firing of a semi-automatic weapon.

FIG. 14 is a flowchart showing another aspect of the operation of another embodiment of the system for aiding the rapid sequential firing of a semi-automatic weapon. The flowchart 1400 begins with step 1402 wherein the gun is loaded and a round is placed in the chamber. In step 1404 the user moves the trigger 502 to a fired position and in step 1406 the hammer 504 is released from the main sear engagement surface and the round is fired. In step 1408, the bolt 600 moves rearwardly and in step 1410 the rearward bolt motion pushes the hammer 504 past the disconnector 506 to a capture point (see FIG. 7B). In step 1412, the rearward motion of the bolt 600 engages the sensor 202 or 510. In step 1414, the processor 206 detects the engagement of the sensor 202 or 510 and waits for disengagement of the sensor. In step 1416, the bolt 600 moves forward, in step 1418 the bolt disengages the sensor, and in step 1420 the processor detects disengagement of the sensor and initiates a pre-set timer. In step 1422 the hammer 504 is allowed to rest on the disconnector 506 and in step 1424, the forward motion of the bolt 600 chambers a new round. In step 1426, the bolt 600 finishes its forward motion and in step 1428 the processor detects the passage of said pre-sent time and engages the solenoid by sending an activation signal to said solenoid. In step 1430, the forward biasing force is applied by the plunger 552 to the trigger 502 (by activation of the solenoid 550 by the processor 206) and the trigger 502 is moved to the unfired position in step 1432. In step 1434 the hammer 504 is released from the disconnector 506 and the hammer 504 is allowed to rest on the main sear. In step 1436, the forward biasing force is removed by the processor 206 by sending an appropriate signal to the solenoid 550.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A method for aiding repeated firing of a semiautomatic firearm having a trigger and a bolt, comprising the steps of:

detecting when the bolt has translated rearwardly at least a first predetermined distance due to firing the firearm;

detecting when the bolt has translated forwardly a second predetermined distance after the bolt has translated rearwardly;

commencing a timer for a predetermined time period corresponding to an amount of time necessary for the bolt to reach a chambered position, responsive to detecting when the bolt has translated forwardly the second predetermined distance; and applying a forward biasing force to translate the trigger from a fired to an un-fired position, responsive to the timer reaching an end of the predetermined time period, and subsequently removing said forward biasing force from the trigger.

2. The method of claim 1, wherein the step of detecting when the bolt has translated rearwardly comprises an electronic sensor transmitting a signal when the bolt contacts said electronic sensor.

3. The method of claim 2, wherein the step of detecting when the bolt has translated forwardly the second predetermined distance after the bolt has translated rearwardly comprises a processor that ceases receiving said signal when the bolt no longer contacts said electronic sensor.

4. The method of claim 3, wherein commencing a timer for a predetermined time period further comprises the processor activating a timing circuit, wherein the timing circuit detects the passage of the predetermined time period.

5. The method of claim 4, wherein the applying a forward biasing force further comprises the processor activating an electromechanical solenoid when the timing circuit detects the passage of the predetermined time period, wherein the electromechanical solenoid is conductively coupled with a battery and mechanically coupled to the trigger via a plunger, wherein the electromechanical solenoid is movable between a fired and un-fired position.

6. A method for aiding repeated firing of a semiautomatic firearm having a trigger and a bolt, comprising:

detecting when the bolt has translated rearwardly at least a first predetermined distance due to firing the firearm, wherein detecting when the bolt has translated rearwardly comprises an electronic sensor transmitting a signal when the bolt contacts said electronic sensor;

applying a forward biasing force to translate the trigger from a fired to an un-fired position, responsive to detecting when the bolt has translated rearwardly at least the first predetermined distance;

detecting when the bolt has translated forwardly a second predetermined distance into a chambered position, wherein detecting when the bolt has translated forwardly comprises a processor commencing a timer for a predetermined time period; and removing said forward biasing force, responsive to detecting that the bolt has translated forwardly into the chambered position, wherein removing said forward biasing force comprises the processor de-activating an electromechanical solenoid when the timing circuit detects the passage of the predetermined time period, wherein the electromechanical solenoid is conductively coupled with a battery and mechanically coupled to the trigger via a plunger, wherein the electromechanical solenoid is movable between a fired and un-fired position.

* * * * *